United States Patent [19]

Oseto et al.

[11] Patent Number: 4,814,249

[45] Date of Patent: Mar. 21, 1989

[54] ELECTROPHOTOGRAPHIC TONER COMPOSITION EXCELLENT IN FIXING PROPERTY AT LOW TEMPERATURE

[75] Inventors: Osamu Oseto, Suita; Nobuo Yamada, Nara, both of Japan

[73] Assignee: Arakawa Kagaku Kogyo Kabushiki Kaisha, Osaka, Japan

[21] Appl. No.: 30,350

[22] Filed: Mar. 26, 1987

[30] Foreign Application Priority Data

Mar. 26, 1986 [JP] Japan ..... 61-68050
May 27, 1986 [JP] Japan ..... 61-121489

[51] Int. Cl.[4] ..... G03G 9/08
[52] U.S. Cl. ..... 430/109
[58] Field of Search ..... 430/105, 109, 104

[56] References Cited

U.S. PATENT DOCUMENTS

| | | | |
|---|---|---|---|
| 4,217,406 | 8/1980 | Tanaka et al. | 430/109 |
| 4,501,832 | 2/1985 | Albers | 427/386 |
| 4,507,376 | 3/1985 | Makita et al. | 430/109 |
| 4,508,806 | 4/1985 | Oseto et al. | 430/109 |

*Primary Examiner*—John L. Goodrow

*Attorney, Agent, or Firm*—Antonelli, Terry & Wands

[57] ABSTRACT

An electrophotographic toner composition having excellent fixing property at a low temperature, offset resistance, blocking resistance and the like comprising a resin binder and a colorant dispersed in the resin binder wherein the resin binder contains a non-linear polyester resin comprising (a) a dicarboxylic acid as an acid component, (b) a rosin glycidyl ester, an esterificated diphenol and a dihydric alcohol having no phenyl ring as an alcohol component, and (c) a polycarboxylic acid having a valency of not less than 3 and/or a polyhydric alcohol having a valency of not less than 3 as a cross-linking component; the content of the rosin glycidyl ester is 5 to 50% by mole based on the component (b), the content of the etherificated diphenol is 20 to 95% by mole based on the component (b) and the component of the dihydric alcohol having no phenyl ring is 0 to 30% by mole based on the component (b); and the content of the component (c) is 0.5 to 20% by weight based on the polyester resin. A polyvalent metal compound may be used in the above polyester resin in order to improve electric properties in high moisture.

2 Claims, No Drawings

ELECTROPHOTOGRAPHIC TONER COMPOSITION EXCELLENT IN FIXING PROPERTY AT LOW TEMPERATURE

BACKGROUND OF THE INVENTION

The present invention relates to a toner composition for electrophotography, and more particularly to an electrophotographic toner composition having excellent fixing property at a low temperature, offset resistance, blocking resistance and the like which contains a specific polyester resin as a binder.

Various electrophotographic methods are hitherto known. There is generally known a method in which a latent electrostatic image is formed on a photosensitive body utilizing a photoconductive material by various means and is then developed with a toner, and after transferring the toner image to a support such as paper if necessary, the toner image is fixed by heating, applying a pressure or using a solvent.

In recent years, a high speed fixing property is required for the toner in order to increase the efficiency of the copying operation. Attempts such as using a thermoplastic resin having a lower softening point and being easily heat fusible as a toner binder to be used in a conventional oven-heat fixing method have been made to provide a toner composition satisfying the requirement. However, mere lowering of the softening point of a resin binder has the defect of causing agglomeration of toner particles, namely blocking phenomenon, during strage or use. Accordingly, as one system for high speed fixing, there has been utilized a fixing method using a heat roller having a good heat conductivity.

Since the heat roller system is higher in heat efficiency than the heat fixing system, a toner can be fixed in a shortened period of time. However, sticking of the toner to the heat roller, namely the so-called offset phenemenon, occurs, since the toner is directly brought into contact with the heat roller. Accordingly, it has been desired to develop a resin capable of solving this problem. A styrene-acrylate copolymer and a styrene-butadiene copolymer are usually known as a resin binder for a toner. These vinyl copolymers are in general poor in offset resistance and fixing property at a low temperature.

One of other resin binders is a bisphenol type epoxy resin. The bisphenol type epoxy resin provides a toner having superior fixing property at a low temperature because of having a lower molecular weight as compared with the vinyl copolymer binder. But, it has a tendency to lowering the offset resistance, because the melt viscosity of the resin is low.

Recently, various polyester resins are proposed as a resin binder used in a toner which is excellent in both offset resistance and fixing property at a low temperature. As disclosed in, e.g., Japanese Unexamined Patent Publication (Tokkyo Kokai) No. 109825/1982, a polyester resin produced by employing an etherificated diphenol as a main component of alcohol and modifying an obtained polyester resin with dicarboxylic acids substituted by a long chain alkyl group has been investigated from the viewpoint of the blocking resistance and offset resistance.

However, according to the inventors' researches, since the dicarboxylic acids substituted by a long chain alkyl group which are used as a modifying component remarkably lower the softening point of the obtained polyester resin, the object of the technique described in the above-mentioned Tokkyo Kokai No. 109825/1982 that an etherificated diphenol is employed as a main component of alcohol in order to maintain the softening point of the polyester resin to be high can not be sufficiently accomplished. Therefore, it has a defect that it is difficult to maintain the balance of the blocking resistance and the fixing property.

Further, as disclosed in Tokkyo Kokai Nos. 29255/1984 and 29256/1984, amorphous polyester resins prepared from etherficated diphenols as a main component of alcohol have been investigated. According to the above-mentioned Tokkyo Kokai Nos. 29255/1984 and 29256/1984, the etherificated diphenols are used as a main component of alcohol in order to maintain the softening point of the polyester resin to be high, and thereby the blocking resistance and the offset resistance of the obtained toner are improved. However, according to the inventors' researches, they should be improved on the point of fixing property at a low temperature.

Accordingly, the present inventors have been examined to develop a polyester resin maintaining the softening point to be high and having well-balanced blocking resistance and fixing property at a low temperature.

It is an object of the present invention to provide a novel electrophotographic toner composition which can solve various problems that conventional techniques can not solve, that is, an electrophotographic toner composition which satisfies well-balanced offset resistance, blocking resistance and fixing property at a low temperature which are required for an electrophotographic toner composition containing a polyester resin as a binder at a time and, in particular, which is suitably used in high speed machines has not yet been obtained.

In general, it is supposed that the improvement of fixing property at a low temperature of the electrophotographic toner composition will be accomplished by lowering the softening point or molecular weight of the binder. Therefore, the inventors have produced various modified polyester resins by introducing a monocarboxylic acid component into polyester resins described in Tokkyo Kokai Nos. 29255/1984 and 29256/1984 and estimated the properties of the toner prepared from the modified polyester resin. However, the toner has not yet satisfied the above properties at the same time.

The present inventors have found that all of the above-mentioned defects can be solved when a polyester resin containing a specific alcohol component, that is, a polyester resin prepared by utilizing a rosin glycidyl ester as one of alcohol components, is employed as a binder. Further, they have found the fact that the fixing property at a low temperature is remarkably improved in case a monocarboxylic acid is employed as one of the acid components of the polyester resin.

In accordance with the above-mentioned their researches, they have eventually accomplished the present invention.

SUMMARY OF THE INVENTION

In accordance with the present invention, there is provided a toner composition for electrophotography excellent in fixing property at a low temperature, offset resistance and blocking resistance comprising a resin binder and a colorant dispersed in the resin binder wherein the resin binder contains a non-linear polyester resin comprising (a) a dicarboxylic acid as an acid component, (b) a rosin glycidyl ester, an etherificated diphenol and a dihydric alcohol having no phenyl ring as an alcohol component, and (c) a polycarboxylic acid having a valency of not less than 3 and/or polyhydric alcohol having a valency of not less than 3 as a crosslinking component; the content of the rosin glycidyl ester is 5 to 50% by mole based on the component (b), the content o the etherificated diphenol is 20 to 95% by mole based on the component (b), and the content of dihydlic alcohol having no phenyl ring is 0 to 30% by mole based on the component (b); and the content of the component (c) is 0.5 to 20% by weight based on the polyester resin.

Also, according to the present invention, there is provided a toner composition for electrophotography comprising the above-mentioned resin binder and 0.2 to 4% by weight of an organic polyvalent metal compound based on the resin binder.

DETAILED DECRIPTION

In the present invention, examples of the dicarboxylic acid used as a acid component, that is, the component (a) are, for instance, orthophthalic acid, isophthalic acid, terephthalic acid, endomethylenetetrahydrophthalic acid, tetrahydrophthalic acid, methyltetrahydrophthalic acid, hexahydrophthalic acid, methylhexahydrophthalic acid, maleic acid, fumaric acid, succinic acid, adipic acid, and anhydrides thereof, and the like.

In order to improve the fixing property at a low temperature of the obtained toner composition, a monocarboxylic acid may be added to the dicarboxylic acid. In this case, it is preferable that the used amount of the monocarboxylic acid is 5 to 65% by mole based on the carboxylic acid component. When the amount of the monocarboxylic acid is less than 5% by mole, the fixing property at a low temperature is scarcely improved. On the other hand, when the amount is more than 65% by mole, there is a tendency that the glass transition temperature and the offset resistance of the obtained polyester resin are lowered.

Examples of the monocarboxylic acid are, for instance, palmitic acid, stearic acid, benzoic acid, chlorobenzoic acid, dichlorobenzoic acid, para-t-butyl benzoic acid, cyclohexahecarboxylic acid, toluic acid, rosins, and the like. Among them, benzoic acid, pare-t-butyl benzoic acid and rosins are preferably used from the viewpoint of the softening point of the obtained polyester resin, the cost and the like. The term "rosins" means various compounds described later to be used as starting materials of the rosin glycidyl ester.

In the present invention, the rosin glycidyl ester used as an alcohol component, that is, the component (b), is prepared by reacting a rosin with epihalo-hydrin in the presence of alkali substances such as organic amines with heating. Examples of the rosin are, for instance, natural rosins such as gum rosin, tall oil rosin and wood rosin, and modified rosins obtained by modifying the natural rosins such as hydrogenated rosin and disproportionated rosin. Abietic acid, dehydroabietic acid, dihydroabietic acid, pimaric acid and isopimaric acid which are effective components of the rosin, are also preferably employed. Tertiary amines and onium salts thereof are preferred as the above-mentioned organic amines. Typical examples of the tertiary amines are triethylamine, dimethylbenzylamine, methyldibenzylamine, tribenzylamine, dimethylaniline, dimethylcyclohexylamine, methyldicyclohexylamine, tripropylamine, tributylamine, N-phenylmorpholine N-methylpiperidine and pyridine. Typical examples of the onium salts of tertiary amines are tetramethylammonium chloride, benzyltriethylammonium chloride, allyltriethylammonium bromide, tetrabutylammonium chloride, methyltrioctylammonium chloride, trimethylamine hydrochloride, triethylamine hydrochloride and pyridine hydrochloride.

The purpose that the rosin glycidyl ester is employed is that as mentioned above, the etherificated diphenol is employed as the main alcohol component, the softening point of the resin is maintained at a high temperature and a polyester resin having well-balanced blocking resistance and fixing property at a low temperature is obtained. Therefore, the used amount of the rosin glycidyl ester is generally from 5 to 50% by mole preferably from 10 to 30% by mole based on 100% by mole of the alcohol component (b) (in which a polyhydric alcohol having a valency of not less than 3 used as a crosslinking component is not included). When the only dicarboxylic acids are employed as the acid component (a), it is more preferable that the amount of the rosin glycidyl ester is from 10 to 26% by mole.

In the present invention, the etherificated diphenols which are employed as main alcohol components are obtained by conducting the addition reaction of bisphenol A and an alkylene oxide such as ethylene oxide or propylene oxide. The alkylene oxide having an added average number of 2 to 16 moles per mole of bisphenol A can be suitably used. The used amount of the etherificated diphenols is from 20 to 95% by mole, preferably from 50 to 90% by mole based on the alcohol component (b) from the viewpoint that the diphenols influence the softening point of the obtained polyester resin. When the only dicarboxylic acids are employed as the acid component (a), it is more preferably that the amount of the etherificated diphenols is from 70 to 90% by mole. When the amount of the etherificated diphenols is more than 95% by mole, it is difficult to obtain a polyester resin of which blocking resistance and fixing property at a low temperature are well-balanced, since the amount of the rosin glycidyl ester modifying the polyester resin is lowered. On the other hand, when the amount is less than 20% by mole, the softening point of the polyester resin is lowered.

In the present invention, the softening point of the polyester resin can be suitably controlled by employing a dihydric alcohol having no phenyl ring as an optional component. Examples of the dihydric alcohol are, for instance, ethylene glycol, diethylene glycol, triethylene glycol, propylene glycol, 1,2-butanediol, 1,3-butanediol, 1,4-butanediol, 1,6-hexanediol, and the like. The used amount of the dihydric alcohol is generally from 0 to 30% by mole, preferably from 0 to 20% by mole based on the alcohol component (b). When the only dicarboxylic acids are used as the acid component (a), the amount of the dihydric alcohol is generally from 0 to 30% by mole, preferably from 1 to 20% by mole, more preferably from 5 to 15% by mole.

The acid component (a) and the alcohol component (b) are used within the range of a ratio of the number of carboxyl group in the acid component (a) to the number of hydroxyl group in the alcohol component (b) being 0.8 to 1.2. When the ratio is out of the above range, the polyester resin having desired constants cannot be obtained.

In the present invention, polycarboxylic acids having a valency of not less than 3 or polyhydric alcohols having a valency of not less than 3 are used as the crosslinking component (c). Examples of the polyhydric alcohols are, for instance, glycerol, trimethylol ethane, trimethylol propane, pentaerythritol, sorbitol, diglycerol, and the like. Examples of the polycarboxylic acids are, for instance, trimellitic acid, pyromellitic acid, acid anhydrides thereof, and the like. The used amount of the crosslinking component (c) is generally from 0.5 to 20% by weight based on the polyester resin since the crosslinking component (c) influences the offset resistance of the obtained polyester resin. When the amount of the crosslinking component (c) is less than 0.5% by weight, the offset resistance comes to be unsufficient. On the other hand, the amount is more than 20% by weight, the fixing property at a low temperature comes to be lowered and further, it has a tendency that the control of synthesizing the polyester resin comes to be difficult.

The polyester resin used as a binder in the present invention is prepared, for instance, by a process in which the carboxylic acid component, the alcohol component and the crosslinking component are charged at once in the amounts within the above-mentioned ranges, and reacted with heating in the presence or absence of a reactive catalyst such as an organotin compound, or a process in which the carboxylic acid component and the alcohol are reacted in the amounts within the above-mentioned ranges with heating in the presence or absence of the above-mentioned catalyst, the crosslinking component is then added in the course of or after the completion of the above reaction, and the reaction is further continued with heating.

Although the resin binder can be obtained in a good yield regardless of the presence or absence of a solvent, a solvent may be employed to smoothly remove the produced water from the reaction system. Typical examples of the solvent are toluen and xylene. The reaction temperature and the reaction time are suitably determined in consideration of the yield of the product. The reaction temperature and the reaction time are usually selected from 100° to 300° C. and 1 to 20 hours. Also, in case that a solvent has been employed upon the reaction, the product can be obtained as a solid by distilling away the solvent under reduced pressure. In accordance with the above-mentioned reaction, the polyester resin of the present invention can be easily prepared. The end point of the reaction can be easily determined, for instance, by measuring the acid value of the prepared resin, the ratio of the insoluble component to the solvent, gel permeation chromatogram the softening point, and the like.

Physical or chemical constants of the polyester resin are suitably determined in consideration of the properties required for the electrophotographic toner composition, that is, fixing property at a low temperature, offset resistance, blocking resistance, and the like. It is desirable that the polyester resin has a softening point of 110° to 180° C. When the softening point is more than 180° C., the fixing property at a low temperature is lowered. On the other hand, when the softening point is less than 110° C., the offset resistance is lowered. Also, it is desirable that the glass transition temperature is from 50° to 80° C. When the glass transition temperature is less than 50° C., the blocking resistance is lowered. On the other hand, when the temperature is more than 80° C., the fixing property at a low temperature is lowered. As the polyester resin, a resin of which 80% by weight is an insoluble component in tetrahydrofuran can be used as well as a resin which can be completely dissolved in tetrahydrofuran. Also, when the polyester resin is employed, it is preferable to use a resin having an acid value of not more than 40, more preferably not more than 20, and a hydroxyl value of not more than 30, more preferably not more than 20, since the acid value and the hydroxyl value influence the electric properties when the obtaind toner is used under the condition of high humidity. When employing an organic polyvalent metal compound xentioned later, it is preferable that the acid value of the polyester resin is from 5 to 40 and the hydroxyl value of the polyester resin is not more than 30, preferably not more than 20.

Conventionally known colorants can be employed in the present invention. Examples of the colorants are, for instance, carbon black, nigrosine dye, aniline blue, Calco Oil Blue, chrome yellow, ultra marine blue, Quinoline Yellow, methylene blue chloride, phthalocyanine blue, Malachite Green Oxalate, lamp black, Rose Bengal and Monastral Red. Known carrier materials such as magnetic substnaces can be employed in the toner composition of the present invention. Typical carriers include, for instance, a metal powder such as iron, manganese, nickel, cobalt and chromium, an iron alloy such as ferrite and magnetite, an alloy or compound of a metal such as cobalt, nickel or manganese, and known ferromagnetic substances. It is preferable that the used amount of the colorant is from 1 to 20 parts by weight based on 100 parts by weight of the polyester resin.

When employing the polyester resin of the present invention as a binder, the binder satisfies the above-mentioned various required properties. If necessary, by admixing an organic polyvalent metal compound with the toner composition in addition to the polyester resin, the offset resistance can be further improved. The organic polyvalent metal compound can be reacted with a carboxyl group of the polyester resin. Examples of the organic polyvalent compounds are, for instance, magnesium acetate, calcium acetate, basic aluminum acetate, calcium stearate and zinc stearate; aluminum isopropoxide, aluminum-n-butoxide; chelate compounds such as aluminum acetylacetonato, nickel acetylacetonato and iron acetylacetonato; other metal complexes such as zinc salicylate and chrome salicylate. Among them, acetylacetone metal complexes and salicylic acid metal complexes are preferable since they improve the crosslinking reactivity remarkable. It is preferable that the used amount of the organic polyvalent metal compound is 0.2 to 4% by weight based on the polyester resin.

As mentioned above, in accordance with the present invention, an electrophotographic toner composition excellent in fixing property at a low temperature which can solve the problems that conventional techniques can not solve sufficiently, that is, all of the properties that offset resistance, blocking resistance and fixing property at a low temperature which are required in toner compositions for electrophotography are not satisfied at a time in a state of equilibration can be obtained. Further, the toner composition of the present invention can solve the problem that an electrophotographic toner composition which is suitably used in high speed machines has not yet been obtained.

The reasons why the polyester resin prepared by employing a specific amount of the rosin glycidyl ester which is the alcohol component has excellent properties and why the polyester resin prepared by employing a specific amount of the monocarboxylic acid such as benzoic acid which is used as an acid component in addition to the above component of the polyester resin has excellent properties have not yet come out clear. It is assumed that these effects are based on the following potentiations.

(1) By employing mcnocarboxylic acids as a polyester component, the amount of components having a low molecular weight which contribute to fixing property at a low temperature is increased.

(2) By employing a rosin glycidyl ester, the amount of a component having a low molecular weight is increased.

(3) The softening point of the polyester resin can be maintained high since the rosin glycidyl ester has a hard and bulky hydrophenanthrene skeleton, and further, the fixing property at a low temperature of a polyester resin is improved since the above skeleton is portioned at side chains of the polyester resin.

Further, since the polyester resin is excellent in dispersibility with various colorants and the like, charge properties of the toner composition come to be stable and the developing properties of the toner are remarkably improved.

The present invention is more specifically described and explained by means of the following Reference Example, Preparation Examples, Comparative Preparation Examples, Examples and Comparative Examples. However, it should be understood that the present invention is not limited to these Examples and various changes and modifications can be made in the invention without departing from the spirit and scope thereof. In the Examples, all parts and % are by weight unless otherewise noted.

REFERENCE EXAMPLE

A glycidyl ester of disproportionated rosin was prepared as follows: A 500 ml. of flask equipped with a stirrer and a reflux condenser was charged with 100 g. of disproportionated rosin (acid value: 162, softening point: 79° C.) having a purity of 87% (the residual 13% portion being non-hydrolysate), 200 g. of epichlorohydrin and 0.1 g. of benzyltrimethylammonium chloride. The reaction was carried out at 80° C. for 4 hours. To the flask was added 16 g. of particulate sodium hydroxide by instalments at the same temperature mentioned above. The temperature was elevated to 100° C. and the reaction was further continued at 100° C. for 2 hours. The deposited sodium chloride was filtered, and the unreacted epichlorohydrin was distilled away from the filtrate by a rotary evaporator. Further, a volatie material was completely removed at 120° C. and 2 mmHg to give an oily light yellow product (yield: 97.2%). The thus obtained product had an acid value of 0 and an epoxy equivalent of 425. The purity calculated on the basis of the epoxy equivalent was 84%.

PREPARATION EXAMPLE 1

A reactor was charged with 37.8 g of the disproportionated rosin glycidyl ester obtained in Reference Example, 141.1 g. of terephthalic acid, 295.2 g. of polyoxypropylene (2,2)-2,2-bis(4-hydroxyphenyl)propane, 7.5 g. of triethylene glycol and 0.2 g of dibutyltin oxide. The reaction was carried out in a nitrogen stream at 240° C. for 8 hours. After it was confirmed that the acid value had attained about 10, 29.0 g. of trimellitic acid anhydride was added thereto and the reaction was continued. The reaction was finished when it was confirmed that the softening point had attained the prescribed point by a flow tester. (The measurement of softening point was carried out with a flow tester by measuring the temperature when the penetration of the needle of the flow tester was 4 mm. Hereinafter the measurement was carried out in the same manner mentioned above.)

The thus obtained resin had a glass transition temperature of 65° C. and a softening point of 140° C.

PREPARATION EXAMPLES 2 TO 5 AND COMPARATIVE PREPARATION EXAMPLE 1 AND 2

The procedure of Preparation Example 1 was repeated except that the kinds and amount of the starting materials were changed as shown in Table 1 to give a polyester resin. The measured results of the resin constant are shown in Table 1.

PREPARATION EXAMPLE 6

A reactor was charged with 36.2 g. of the disproportionated rosin glycidyl ester obtained in Reference Example, 127.9 g. of terephthalic acid, 14.3 g. of para-t-butyl benzoic acid, 313.2 g. of polyoxypropylene (2,2)-2,2-bis(4-hydroxyphenyl)propane, 7.5 g. of triethylene glycol and 0.2 g. of dibutyltin oxide. The reaction was carried out in a nitrogen stream at 240° C. for 8 hours. After it was confirmed that the acid value had attained about 13, 28.8 g. of trimellitic acid ahydride was added thereto and the reaction was continued. The reaction was finished when it was confirmed that the softening point had attained the prescribed point by using a flow tester.

The thus obtained resin had a glass transition temperature of 75° C. and a softening point of 150° C.

PREPARATION EXAMPLES 7 to 12 AND COMARATIVE PREPARATION EXAMPLES 3 TO 6

The procedure of Preparation Example 6 was repeated except that the kinds and amount of the starting materials were changed as shown in Table 1 to give a polyester resin. The measured results of the resin constant are shown in Table 1.

TABLE 1

| | Starting materials | | | | |
|---|---|---|---|---|---|
| Preparation Example | Rosin glycidyl ester (g) | Etherificated diphenol (g) | Dihydric alcohol (g) | Monocarboxylic acid (g) | Dicarboxylic acid (g) |
| 1 | Ref. Ex. 37.8 | BPA(2,2)PO 295.2 | TEG 7.5 | — | TPA 141.1 |
| 2 | Ref. Ex. 71.0 | BPA(2,2)PO 270.0 | TEG 15.0 | — | TPA 149.4 |
| 3 | Ref. Ex. 118.3 | BPA(2,2)PO | TEG | — | TPA |

TABLE 1-continued

| | | | | | |
|---|---|---|---|---|---|
| | | 234.0 | 15.0 | | 149.4 |
| 4 | Ref. Ex. 118.3 | BPA(2,2)PO | TEG | — | TPA |
| | | 216.0 | 15.0 | | 166.0 |
| 5 | Ref. Ex. 189.2 | BPA(2,2)PO | EG | — | TPA |
| | | 126.0 | 15.5 | | 141.1 |
| 6 | Ref. Ex. 36.2 | BPA(2,2)PO | TEG | PTBA | TPA |
| | | 313.2 | 7.5 | 14.3 | 127.9 |
| 7 | Ref. Ex. 67.8 | BPA(2,2)PO | TEG | PTBA | TPA |
| | | 270.0 | 15.0 | 26.7 | 99.7 |
| 8 | Ref. Ex. 67.8 | BPA(2,2)PO | TEG | BA | TPA |
| | | 270.0 | 15.0 | 18.3 | 99.7 |
| 9 | Ref. Ex. 67.8 | BPA(2,2)PO | TEG | Rondis R | TPA |
| | | 234.0 | 30.0 | 45.1 | 99.7 |
| 10 | Ref. Ex. 113.0 | BPA(2,2)PO | — | PTBA 35.6 | TPA |
| | | 270.0 | | STA 13.6 | 74.8 |
| 11 | Ref. Ex. 113.0 | BPA(2,2)PO | TEG | PTBA | TPA |
| | | 180.0 | 15.0 | 53.4 | 116.3 |
| 12 | Ref. Ex. 180.0 | BPA(2,2)PO | EG | PTBA | TPA |
| | | 126.0 | 15.5 | 62.3 | 41.5 |
| Comparative Preparation Example 1 | — | BPA(2,2)PO 288.0 | TEG 30.0 | — | TPA 149.4 |
| Comparative Preparation Example 2 | — | BPA(2,2)PO 360.0 | — | — | TPA 107.9 Dodecyl succinic acid 71.0 |
| Comparative Preparation Example 3 | — | BPA(2,2)PO 360.0 | — | — | TPA 141.2 |
| Comparative Preparation Example 4 | — | BPA(2,2)PO 360.0 | — | PTBA 26.7 | TPA 99.7 |
| Comparative Preparation Example 5 | — | BPA(2,2)PO 360.0 | — | PTBA 71.2 | TPA 58.2 |
| Comparative Preparation Example 6 | Ref. Ex. 67.8 | BPA(2,2)PO 270.0 | TEG 15.0 | — | TPA 141.2 |

| Preparation Example | Starting materials: Tri- or higher valent polybasic acid or tri- or higher valent polyhydric alcohol (g) | | Resin constant: Acid value | Glass transition temperature (°C.) | Softening point (°C.) | Percentage of undissolved THF (%) |
|---|---|---|---|---|---|---|
| 1 | TMA | 29.0 | 17 | 65 | 140 | 20 |
| 2 | TMA | 19.3 | 23 | 69 | 145 | 30 |
| 3 | TMA | 19.3 | 20 | 71 | 150 | 25 |
| 4 | GLY | 4.6 | 19 | 72 | 166 | 52 |
| 5 | TMA | 29.0 | 17 | 74 | 150 | 30 |
| 6 | TMA | 28.8 | 13 | 75 | 150 | 30 |
| 7 | TMA | 48.0 | 12 | 68 | 153 | 35 |
| 8 | TMA | 48.0 | 13 | 66 | 150 | 30 |
| 9 | TMA | 48.0 | 12 | 67 | 160 | 45 |
| 10 | TMA | 57.6 | 10 | 63 | 165 | 60 |
| 11 | GLY | 13.8 | 15 | 65 | 148 | 25 |
| 12 | TMA | 76.9 | 10 | 55 | 160 | 45 |
| Comparative Preparation Example 1 | TMA | 19.3 | 16 | 68 | 148 | 25 |
| Comparative Preparation Example 2 | TMA | 19.3 | 17 | 55 | 125 | 20 |
| Comparative Preparation Example 3 | TMA | 28.8 | 16 | 75 | 162 | 50 |
| Comparative Preparation Example 4 | TMA | 48.0 | 13 | 72 | 160 | 48 |
| Comparative Preparation Example 5 | TMA | 48.0 | 15 | 69 | 155 | 40 |
| Comparative Preparation | TMA | 28.8 | 13 | 68 | 155 | 38 |

TABLE 1-continued

| Example 6 |
|---|

(Note)
BPA(2,2)PO: Polyoxypropylene(2,2)-bis(4-hydroxyphenyl)propane
PTBA: Para tert-butyl benzoic acid
TEG: Triethylene glycol
BA: Benzoic acid
EG: Ethylene glycol
STA: Stearic acid
Rondis R: Disproportionated rosin (made by Arakawa Kagaku Kogyo Kabushiki Kaisha)
TMA: Trimellitic acid anhydride
TPA: Terephthalic acid
GLY: Glycerol
Percentage of undissolved THF: Percentage of undissolved tetrahydrofulan

PREPARATION EXAMPLES 13 TO 17 AND COMPARATIVE PREPARATION EXAMPELS 7 AND 8

The procedure of Example 1 was repeated except that each kind and amount of the starting material was changed as in Preparation Examples 1 to 5 and Comparative Preparation Examples 1 and 2 and the reaction was finished when the acid value had attained the value shown in Table 2 to give a polyester resin. The measured results of resin constant are shown in Table 2.

PREPARATION EXAMPLES 18 to 24 AND COMPARATIVE PREPARATION EXAMPLES 9 TO 12

The procedure of Preparation Example 6 was repeated to give a polyester resin except that each in and amount of the starting material was changed as in Preparation Examples 6 to 12 and Comparative preparation Examples 3 to 6 and the reaction was finished when the acid value had attained the value shown in Table 2. The measured results of resin constant are shown in Table 2.

EXAMPLES 1 AND 6

4 parts of carbon black MA #100 (made by MITSUBISHI CHEMICAL INDUSTRIES LTD.) and 2 parts of viscol 550P (a polypropylene wax made by Sanyo Chemical Industries, Ltd.) were added to 100 parts of the polyester resin obtained in Preparation Example 1 (in case of Example 1) and in Preparation Example 6 (in case of Example 6), and they were throughly mixed and kneaded by an extruded. After cooling, the extrudate was roughly pulverized to be 1 cm cube and was finely divided by a jet pulverizer, and then was followed by classification using a wind power-classifier. In the above manner, there was obtained a toner having an average particle size of 13 to 15 μm.

A developer was prepared by adding 95 parts of iron powder carrier to 5 parts of the toner, and a latent electrostatic image was developed therewith by using an electrophotographic copying machine. The developed latent electrostatic image was transferred on a sheet of ordinal plain paper and fixed a fixing rollar having polytetrafluoroethylene coated surface. At that time, the temperature of the fixing roller was variously changed. In Example 1, the fixing percentage (%) was measured after a cellophane adhesive tape was stuck thereto and

TABLE 2

| | Starting materials and the amount thereof | Acid value | Glass transition temperature (°C.) | Resin constant: Softening point (°C.) | Resin constant: Percentage of undissolved THF (%) |
|---|---|---|---|---|---|
| Preparation Example | | | | | |
| 13 | Same as in Pre. Ex. 1 | 20 | 65 | 132 | 0 |
| 14 | Same as in Pre. Ex. 2 | 25 | 67 | 135 | 10 |
| 15 | Same as in Pre. Ex. 3 | 24 | 71 | 138 | 0 |
| 16 | Same as in Pre. Ex. 4 | 22 | 71 | 137 | 5 |
| 17 | Same as in Pre. Ex. 5 | 20 | 74 | 142 | 0 |
| 18 | Same as in Pre. Ex. 6 | 15 | 73 | 125 | 0 |
| 19 | Same as in Pre. Ex. 7 | 14 | 68 | 135 | 0 |
| 20 | Same as in Pre. Ex. 8 | 14 | 65 | 130 | 0 |
| 21 | Same as in Pre. Ex. 9 | 14 | 66 | 133 | 0 |
| 22 | Same as in Pre. Ex. 10 | 12 | 62 | 142 | 10 |
| 23 | Same as in Pre. Ex. 11 | 17 | 65 | 132 | 0 |
| 24 | Same as in Pre. Ex. 12 | 12 | 54 | 145 | 15 |
| Comparative Preparation Example | | | | | |
| 7 | Same as in Com. Pre. Ex. 1 | 18 | 66 | 138 | 0 |
| 8 | Same as in Com. Pre. Ex. 2 | 20 | 54 | 115 | 0 |
| 9 | Same as in Com. Pre. Ex. 3 | 18 | 73 | 135 | 0 |
| 10 | Same as in Com. Pre. Ex. 4 | 14 | 71 | 138 | 0 |
| 11 | Same as in Com. Pre. Ex. 5 | 16 | 68 | 130 | 0 |
| 12 | Same as in Com. Pre. Ex. 6 | 14 | 67 | 132 | 0 |

peeled off. In Example 6, fixing percentage (%) was measured after the surface was rubbed with an eraser (reciprocation time was 10 times). The standard of the latter rubbing is severer than that of the former peeling off. The offset resistance was observed by maked the eyes and was estimated according to the following criteria.

O: No offset

Δ: Slight offset

X: Large offset

The blocking resistance was estimated by employing 20 g. of the toner, allowing to stand for 24 hours in a thermostat of which temperature was 50° C., cooling at a room temperature, and observing the degree of the massiveness.

EXAMPLES 2 TO 5 AND COMPARATIVE EXAMPLES 1 and 2

The procedure of Example 1 was repeated to produce toners from polyester resins prepared in Preparation Examples 2 to 5 and Comparative Preparation Examples 1 and 2, and the properties of the toners were estimated. The results are shown in table 3.

EXAMPLES 7 TO 12 AND COMPARATIVE EXAMPLES 3 TO 6

The procedure of Example 6 was repeated to produce toners from polyester resins prepared in Preparation Examples 7 to 12 and Comparative Examples 3 to 6, and the properties of the toners were estimated. The results are shown in Table 3.

TABLE 3

| | Blocking | Fixing percentage (%) | | | Offset resistance | | |
|---|---|---|---|---|---|---|---|
| | | 140° C. | 160° C. | 180° C. | 170° C. | 200° C. | 240° C. |
| Example | | | | | | | |
| 1 | Nothing | 77 | 90 | 94 | | | |
| 2 | " | 86 | 98 | 99 | | | |
| 3 | " | 85 | 98 | 99 | | | |
| 4 | " | 85 | 97 | 99 | | | |
| 5 | " | 79 | 90 | 94 | | | |
| 6 | " | 78 | 85 | 93 | | | |
| 7 | " | 84 | 90 | 95 | | | |
| 8 | " | 86 | 95 | 98 | | | |
| 9 | " | 85 | 94 | 97 | | | |
| 10 | " | 85 | 95 | 97 | | | |
| 11 | " | 84 | 93 | 96 | | | |
| 12 | " | 76 | 87 | 92 | | | |
| Comparative Example | | | | | | | |
| 1 | Nothing | 52 | 66 | 78 | | Δ | X |
| 2 | Blocking was observed | 65 | 78 | 85 | | Δ | X |
| 3 | Nothing | 43 | 58 | 66 | | | Δ |
| 4 | " | 55 | 63 | 75 | | | Δ |
| 5 | " | 65 | 75 | 82 | | Δ | Δ |
| 6 | " | 68 | 77 | 85 | | | |

EXAMPLE 13

To 100 parts of polyester resin obtained in Preparation Example 13 was added to 4 parts of carbon black MA#100, 2 parts of Viscol 550P and 1 part of aluminum acetylacetonato, and they were throughly mixed and kneaded by an extruder. The obtained extrudant was prepared to give a toner in the same manner as in Example 1 and the properties of the toner were observed. The results are shown in Table 4.

EXAMPLES 14 TO 17 AND COMPARATIVE EXAMPLES 7 AND 8

The procedure of Example 13 was repeated to give toners except that polyester resins of Preparation Exmples 14 to 17 and Comparative Preparation Examples 7 and 8 are employed and the properties of toners were observed. The result are shown in Table 4.

EXAMPLE 18

To 100 parts of polyester resin obtained in Preparation Example 18 was added to 4 parts of carbon black MA #100, 2 parts of viscol 550P and 1 part of aluminum acetylacetonato, and they were throughly mixed and kneaded by an extruder. The obtained extrudant was prepared to give a toner in the same manner as in Example 6 and the properties of the toner were observed. The results are shown in Table 4.

EXAMPLES 19 TO 24 AND COMPARATIVE EXAMPELS 9 AND 12

The procedures of Examples 18 was repeated to give toners except that polyester resins of Preparation Examples 19 to 24 and Comparative Examples 9 to 12 are employer, and the properties of the toners were observed. The results are shown in Table 4.

TABLE 4

| | Blocking | Fixing percentage (%) | | | Offset resistance | | |
|---|---|---|---|---|---|---|---|
| | | 140° C. | 160° C. | 180° C. | 170° C. | 200° C. | 240° C. |
| Example | | | | | | | |
| 13 | Nothing | 75 | 90 | 95 | | | |
| 14 | " | 85 | 97 | 98 | | | |
| 15 | " | 87 | 97 | 99 | | | |

TABLE 4-continued

| | Blocking | Fixing percentage (%) | | | Offset resistance | | |
|---|---|---|---|---|---|---|---|
| | | 140° C. | 160° C. | 180° C. | 170° C. | 200° C. | 240° C. |
| 16 | " | 86 | 96 | 99 | | | |
| 17 | " | 77 | 90 | 95 | | | |
| 18 | " | 76 | 84 | 92 | | | |
| 19 | " | 84 | 91 | 95 | | | |
| 20 | " | 86 | 95 | 97 | | | |
| 21 | " | 88 | 96 | 99 | | | |
| 22 | " | 85 | 95 | 98 | | | |
| 23 | " | 83 | 94 | 96 | | | |
| 24 | " | 78 | 88 | 93 | | | |
| Comparative Example | | | | | | | |
| 7 | Nothing | 50 | 65 | 75 | | Δ | Δ |
| 8 | Blocking was observed | 64 | 75 | 84 | | Δ | Δ |
| 9 | Nothing | 40 | 52 | 65 | | | Δ |
| 10 | " | 52 | 68 | 79 | | | Δ |
| 11 | " | 61 | 76 | 84 | | Δ | Δ |
| 12 | " | 65 | 75 | 86 | | | |

In addition to the ingredients used in the examples, other ingredients can be used in the Examples as set forth in the specification to obtain substantially the same results.

What is claimed is:

1. A toner composition for electrophotography excellent in fixing property at a low temperature, offset resistance and blocking resistance comprising a resin binder and a colorant dispersed in said resin binder wherein said resin binder contains a non-linear polyester resin comprising (a) a dicarboxylic acid containing a monocarboxylic acid in an amount of 5 to 65% by mole based on the carboxylic acid component as an acid component, (b) a rosin glycidyl ester, an etherificated diphenol and a dihydric alcohol having no phenyl ring as an alcohol component, and (c) a polycarboxylic acid having a valency of not less than 3 and/or a polyhydric alcohol having a valency of not less than 3 as a crosslinking component; the content of said rosin glycidyl ester is 5 to 50% by mole based on said component (b), the content of said etherificated diphenol is 20 to 95% by mole based on said component (b) and the content of said dihydric alcohol having no phenyl ring is 0 to 30% by mole based on said component (b); and the content of said component (c) is 0.5 to 20% by weight based on said polyester resin.

2. A toner composition for electrophotography excellent in fixing property at a low temperature, offset resistance and blocking resistance comprising a resin binder and a colorant dispersed in said resin binder wherein said resin binder contains a non-linear polyester resin comprising (a) a dicarboxylic acid containing monocarboxylic acid in an amount of 5 to 65% by mole based on the carboyxlic acid component as an acid component, (b) a rosin glycidyl ester, an etherificater diphenol and a dihydric alcohol having no phenyl ring as an alcohol component, and (c) a polycarboxylic acid having a valency of not less than 3 and/or a polyhydric alcohol having a valency of not less than 3 as a crosslinking component; the content of said rosin glycidyl ester is 5 to 50% by mole based on said component (b), the content of said etherificated diphenol is 20 to 95% by mole based on said component (b) and the content of said dihydric alcohol having no phenyl ring is 0 to 30% by mole based on said component (b); the content of said component (c) is 0.5 to 20% by weight based on said polyester resin; and 0.2 to 4% by weight of an organic polyvalent metal compound is contained based on said resin binder.

* * * * *